US007327971B2

(12) United States Patent
Oda

(10) Patent No.: US 7,327,971 B2
(45) Date of Patent: Feb. 5, 2008

(54) FITTING CONSTRUCTION AND DEVELOPER HOLDING UNIT AND IMAGE FORMING APPARATUS THAT USE THE FITTING CONSTRUCTION

(75) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 203 days.

(21) Appl. No.: 11/040,073

(22) Filed: Jan. 21, 2005

(65) Prior Publication Data

US 2005/0169676 A1 Aug. 4, 2005

(30) Foreign Application Priority Data

Jan. 30, 2004 (JP) ..... 2004-024194

(51) Int. Cl.
*G03G 15/08* (2006.01)

(52) U.S. Cl. ..... 399/119; 399/120; 399/262

(58) Field of Classification Search ..... 399/111, 399/119, 120, 123, 262, 360; 222/DIG. 1
See application file for complete search history.

(56) References Cited

U.S. PATENT DOCUMENTS 4,441,636 A * 4/1984 Yamashita et al. ..... 222/541.6
4,779,749 A 10/1988 Geiger
5,118,013 A * 6/1992 Mutou et al. ..... 222/171
5,280,324 A * 1/1994 Ono et al. ..... 399/262
5,296,900 A * 3/1994 Saijo et al. ..... 399/260
5,983,059 A * 11/1999 Oka et al. ..... 399/262
6,219,506 B1 * 4/2001 Morinaga et al. ..... 399/109
6,246,848 B1 * 6/2001 Morinaga et al. ..... 399/106
6,885,840 B2 * 4/2005 Huang et al. ..... 399/262
2003/0012583 A1 1/2003 Okoshi

FOREIGN PATENT DOCUMENTS

EP 0 829 774 A2 3/1998
JP 02301785 A * 12/1990
JP 07295357 A * 11/1995
JP 8-185031 A 7/1996
JP 09222786 A * 8/1997
JP 2000-172057 A 6/2000
JP 2003-001591 A 1/2003

* cited by examiner

*Primary Examiner*—Robert Beatty
(74) *Attorney, Agent, or Firm*—Akin Gump Strauss Hauer & Feld LLP

(57) ABSTRACT

A fitting construction for a developer holding apparatus includes a housing member and a lid. The housing member has a developer chamber having a first wall that defines an opening. The lid fittingly closes the opening, the lid having a smaller tensile modulus of elasticity than the housing member and a groove that is formed in a peripheral portion of the lid and receives the projection therein. The groove extends all around the opening. The first wall fittingly engages into the groove to seal the opening. The lid includes a second wall that closes the opening, an third wall that projects from the second wall, and an fourth wall that projects from the second wall and extends to surround the third wall to define the groove between the third wall and the fourth wall.

27 Claims, 10 Drawing Sheets

FITTING CONSTRUCTION AND DEVELOPER HOLDING UNIT AND IMAGE FORMING APPARATUS THAT USE THE FITTING CONSTRUCTION

FIELD OF THE INVENTION

The present invention relates to a fitting construction for use in an electrophotographic image-forming apparatus such as a printer, a facsimile machine, and a copying machine.

DESCRIPTION OF THE RELATED ART

Conventional electrophotographic image-forming apparatus use an electrophotographic image-forming process including exposing, developing, transferring, and fixing. A charging roller charges the surface of a photoconductive drum to a predetermined potential. An exposing unit irradiates the charged surface of the photoconductive drum with light in accordance with print data to form an electrostatic latent image. A developing roller applies developer to the electrostatic latent image to develop the electrostatic latent image into a visible image. A transfer roller transfers the visible image onto a recording medium. The visible image on the recording medium is then fixed in a fixing unit. The image-forming apparatus includes a developer-holding unit.

One such developer-holding unit is one that holds fresh developer to be supplied to the developing unit and is replaced when the developer is exhausted. Another example of developer-holding unit is a process cartridge that includes an image-bearing body and a developing section, the process cartridge being in an integral construction unit and replaceable in unison. Still another example is a developer-collecting unit that collects developer remaining on an image bearing body and a transfer unit.

Some of developer holding sections have a housing that holds the developer and a lid that closes an opening formed in the housing.

If the housing is molded from a plastic material, small gaps between the housing and the lid fitted into the housing require to be sealed to prevent the developer from leaking. Specifically, the gaps are filled with a sealing material such as sponge or adhesive, or welded by heat for providing a seal against leakage of the developer. Alternatively, an elastomer material similar to a plastic material is used to form a resilient projection for providing an effective sealing against the developer from migrating therethrough. This projection may be formed through an additional molding stage (second stage) where the projection is integrally molded with the fitting portion.

However, the aforementioned construction suffers from the following problems. An injection-molded integral item includes at least two molding components and therefore requires two stages of molding. This leads to expensive molded parts. A sealing method that uses a sealing material such as sponge requires an increased number of parts, and is therefore costly.

SUMMARY OF THE INVENTION

The present invention was made in view of the aforementioned problems of the conventional developing unit.

An object of the invention is to provide a sealed fitting construction that uses injection molding that is simple, the fitting construction requiring a less number of parts and therefore being formed at low cost.

A fitting construction for a developer holding apparatus includes a housing member and a lid. The housing member has a developer chamber having a first wall that defines an opening. The lid fittingly closes the opening. The lid has a smaller tensile modulus of elasticity than the housing member and a groove that is formed in a peripheral portion of the lid, and receives the peripheral projection therein. The groove extends all around the opening. The first wall fittingly engages into the groove to seal the opening.

The housing is formed of one of polyethylene, polypropylene, and acrylonitrile-butadiene-styrene (ABS) and the lid 2 is formed of polyethylene.

The lid includes a second wall that closes the opening, a third wall that projects from the second wall, and a fourth wall that projects from the second wall and extends to surround the third wall to define the groove between the third wall and the fourth wall;

wherein the first wall has an outer dimension equal to or larger than an inner dimension of the fourth wall.

The first wall has an inner dimension equal to or smaller than an outer dimension of the third wall.

The fourth wall has a higher height than the third wall.

The third wall has a chamfered portion formed at an outer corner of the third wall, the chamfered portion extending all around the third wall and having a width large than a difference between an inner dimension of the third wall and an outer dimension of the third wall.

The housing has a first engagement portion and the lid has a second engagement portion. The first wall is press-fitted into the groove and the first engagement portion fits into the second engagement portion, so that the housing is locked into the lid.

The first wall that defines the opening has portions that extend at an angle with each other.

The fourth wall has a lower height than the third wall.

The first engagement portion is a projection formed on an outer surface of the first wall and the second engagement portion is a portion defining a hole formed in the lid.

The first engagement portion is a loop-like groove that extends all around the outer surface and the second engagement portion is a loop-like projection that extends all around the inner surface of the fourth wall.

The third wall has at least one loop-like groove formed in an outer surface of the third wall.

An image-forming apparatus incorporates the aforementioned construction. The apparatus includes an image-bearing body, a charging section, an exposing section, a developing section, and a transferring section. The charging section charges a surface of the image bearing body. The exposing section irradiates the charged surface of the image bearing body to form an electrostatic latent image on the surface. The developing section develops the electrostatic latent image into a visible image. The transferring section transfers the visible image onto a print medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

Figure 1:
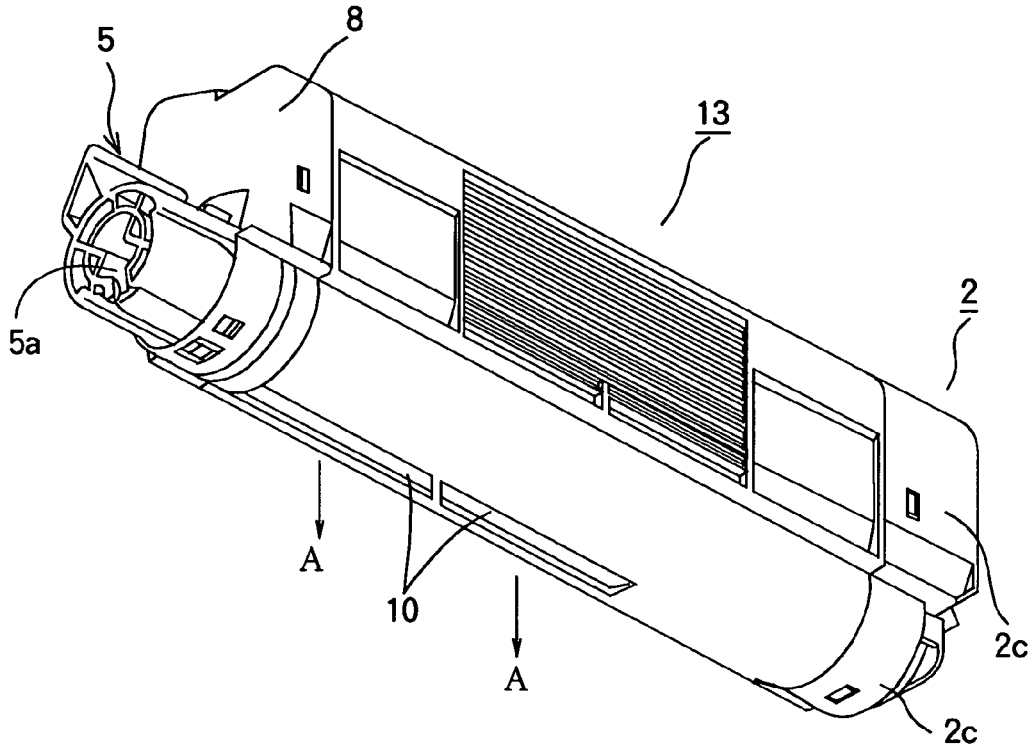
FIGS. 1 and 2 are perspective views of a toner cartridge according to a first embodiment.
Figure 2:
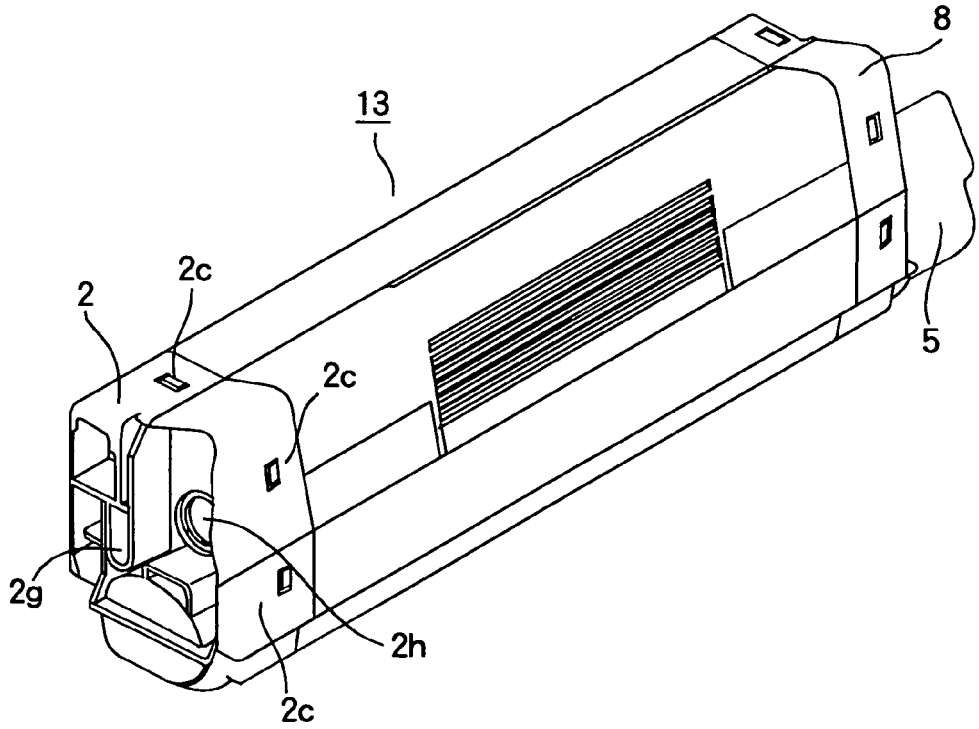

FIGS. 1 and 2 are perspective views of a toner cartridge 13 according to a first embodiment of the present invention. The toner cartridge 13 is attached to a process cartridge 12. The toner cartridge 13 has a fresh toner chamber 4 from which fresh, unused toner is supplied and a waste toner chamber 3 that accommodates waste toner therein. A lid 2 closes one end of the fresh toner chamber 4 and a lid 8 closes one end of the waste toner chamber 3. The lid 8 has an operating lever 5 for operating a shutter that opens and closes a toner-discharging opening 11. When the operating lever 5 is pivoted to an OPEN position, the shutter is opened so that the toner is discharged through the toner-discharging opening 11 by gravity in a direction shown by arrow A. When the operating lever 5 is pivoted to a CLOSED position, the shutter is be closed. The lid 2 has a waste toner-receiving opening 2*h* through which the waste toner is received. The lid 2 also has a recess 2*g* formed near the waste toner-receiving opening 2*h*, the recess facilitating the attachment of the toner cartridge 13 into the process cartridge 12.

Figure 3:
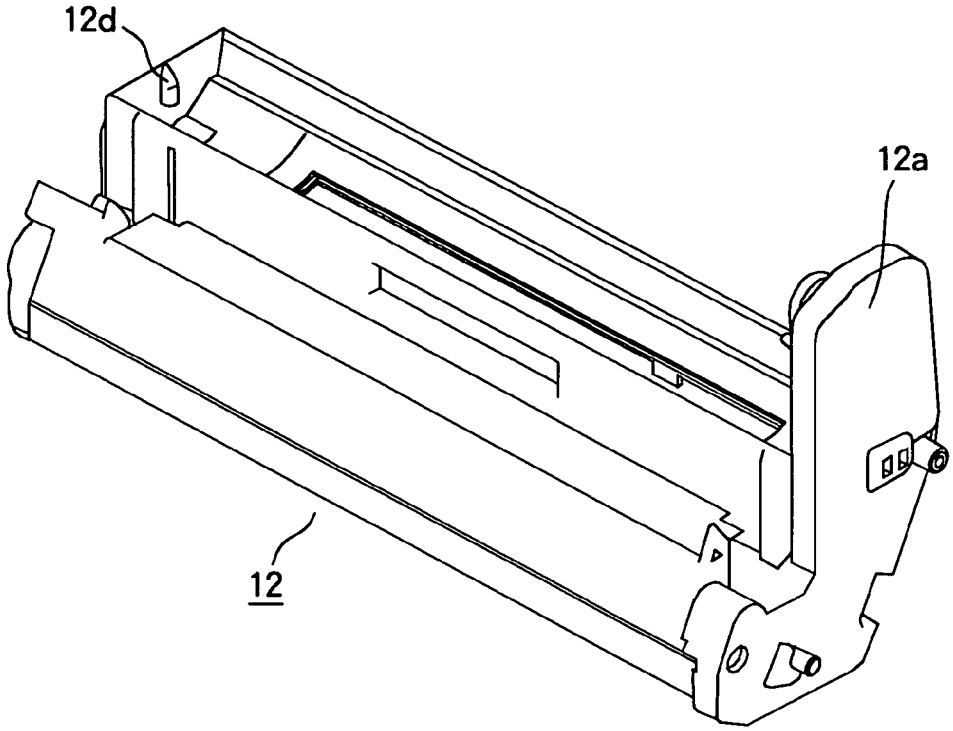
FIGS. 3 and 4 are perspective views of a process cartridge before the toner cartridge is mounted on it.
Figure 4:
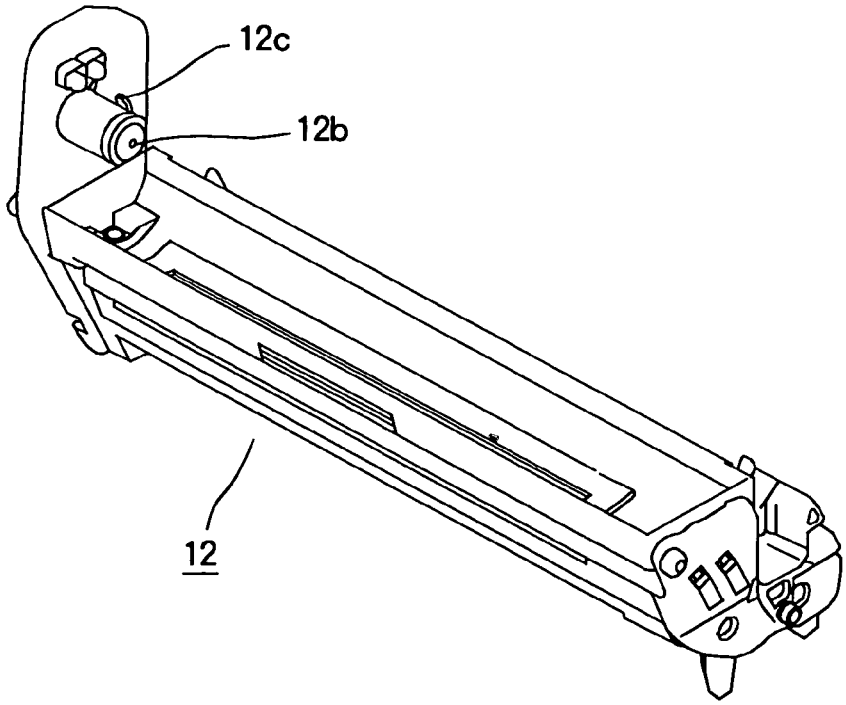
Figure 5:
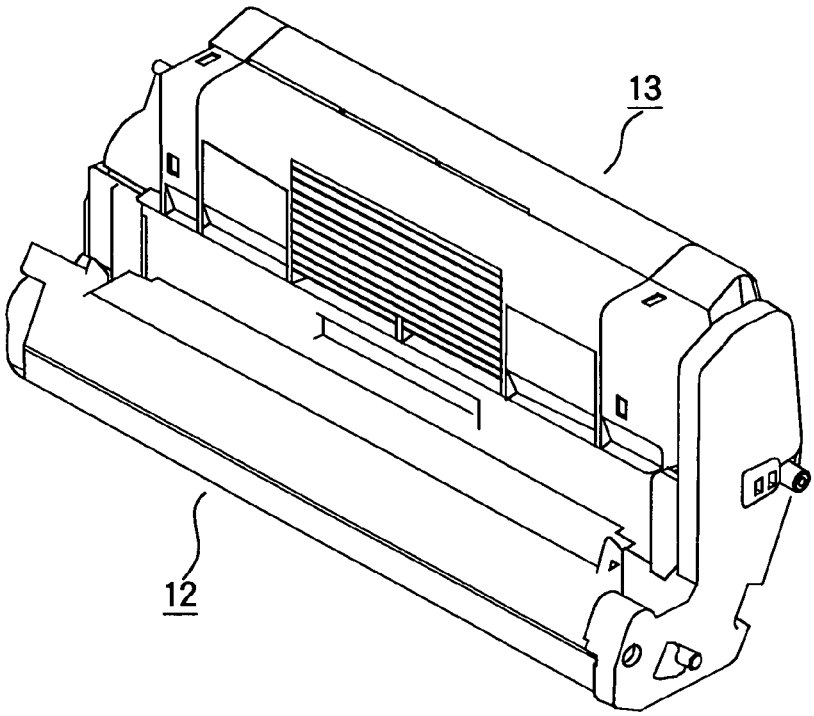
FIGS. 5 and 6 are perspective views of the process cartridge after the toner cartridge has been mounted on it.
Figure 6:
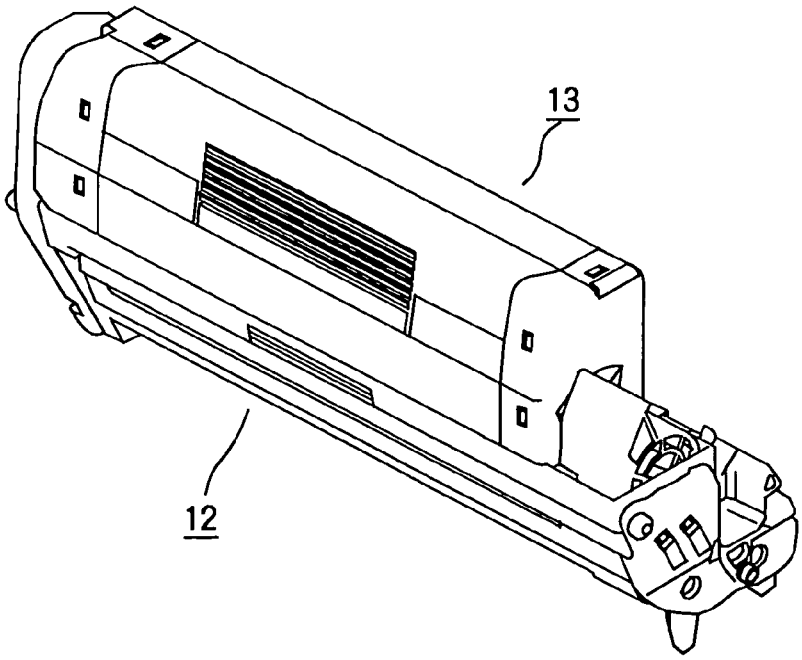

FIGS. 3 and 4 are perspective views of the process cartridge 12 before the toner cartridge 13 is mounted on it. FIGS. 5 and 6 are perspective view s of the process cartridge 12 after the toner cartridge 13 has been mounted on it. Referring to FIGS. 3 and 4, the process cartridge 12 generally extends in a longitudinal direction and has a side plate 12*a* at its one longitudinal end and a projection 12*d* at its another longitudinal end. The projection 12*d* facilitates positioning of the toner cartridge 13 when the toner cartridge 13 is mounted to the process cartridge 12. A waste toner-discharging opening 12*b* is provided on the inside of the side plate 12*a*, directing the waste toner into the waste toner chamber 12.

When the toner cartridge 13 is attached to the process cartridge 12, the recess 2*g* of the lid 2 of the toner cartridge 13 receives a projection 12*c* of the side plate 12*a*, thereby positioning the toner cartridge 13 in the lateral direction relative to the process cartridge 12. Upon fitting the projection 12*c* into the recess 2*g*, the waste toner-discharging opening 12*b* is coupled to the waste toner-receiving opening 2*h*.

When the projection 12*d* fits into a recess 5*a* formed in the operating lever 5 and the operating lever 5 is pivoted, the toner cartridge 13 is firmly fastened vertically to the process cartridge 12. The pivotal motion of the operating lever 5 also causes the toner-discharging opening 11 to open, so that the toner is discharged from the toner cartridge 13 into the process cartridge 12.

Figure 7:
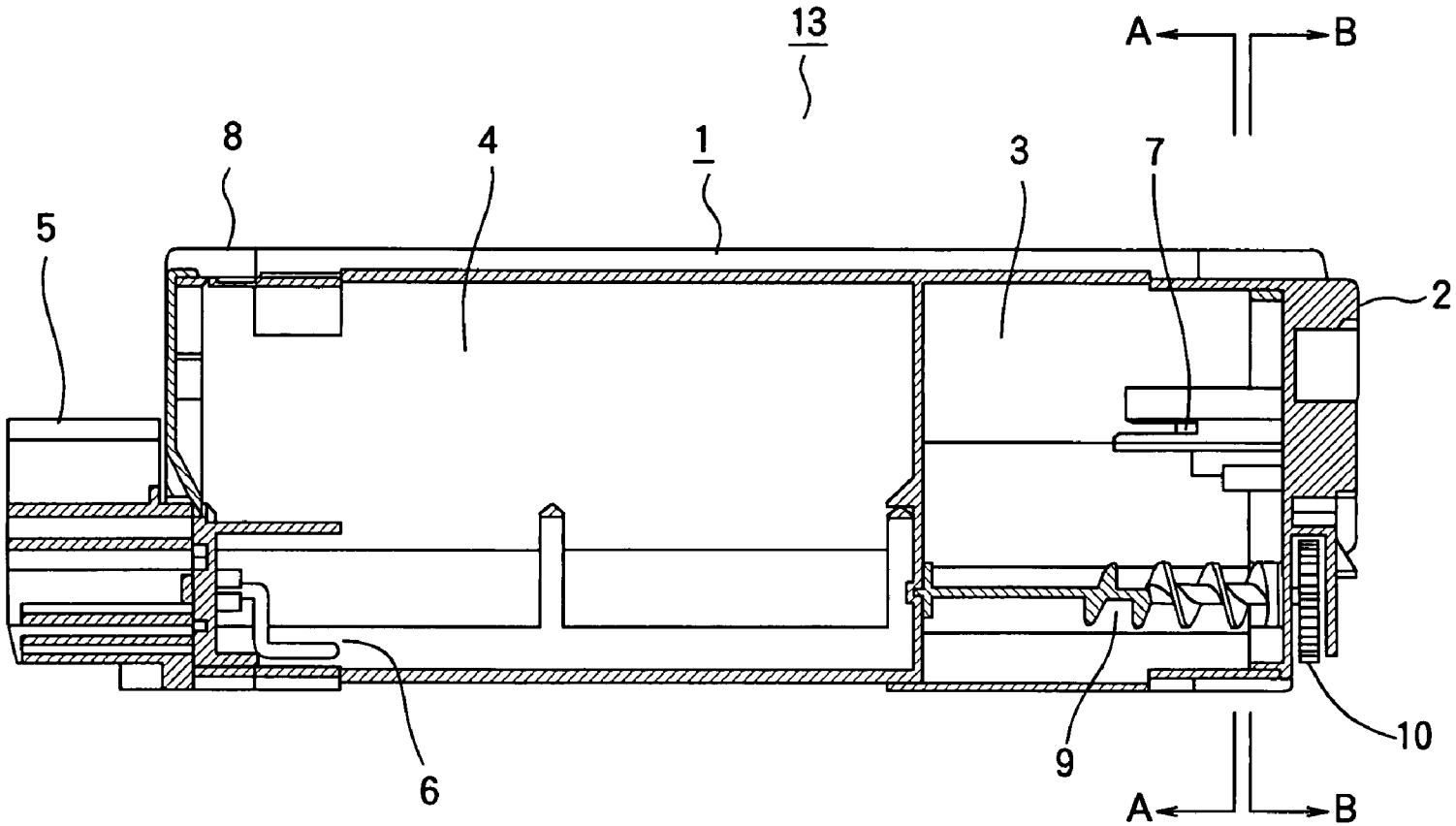
FIG. 7 is a cross-sectional view of the toner cartridge according to the first embodiment.

FIG. 7 is a cross-sectional view of the toner cartridge 13 according to the first embodiment. The toner cartridge 13 has a housing 1 that includes the fresh toner chamber 4 and the waste toner chamber 3. The lid 2 closes one end of the waste toner chamber 3 and lid 8 closes one end of the fresh toner chamber 4. The pivotal motion of the lever 5 of the shutter (not shown) causes the toner-discharging opening 11 (FIG. 1) to open, so that the toner is discharged from the toner cartridge 13. A drive force is transmitted to a gear 10 from the process cartridge side, the gear 10 driving a spiral 9 in rotation. The spiral 9 and an agitator 6 rotate together, the agitator 6 agitating the toner in the fresh toner chamber 4 while the spiral 9 moving the waste toner in the waste toner chamber 3. The agitator 6 is shown only in part. The toner cartridge 13 has a slide type lid 7 that prevents the waste toner from leaking from the waste toner chamber 3 to the outside of the waste toner chamber 3.

The toner cartridge 13 is attached to the process cartridge 12 (FIGS. 3 and 4) and supplies fresh, unused toner and collects waste toner.

Figure 8:
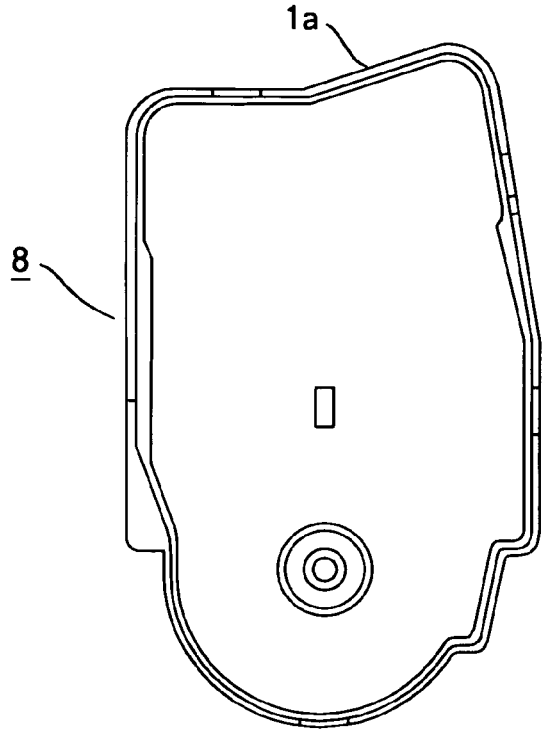
FIG. 8 is a side view of the housing taken along line A-A of FIG. 7.
Figure 9:
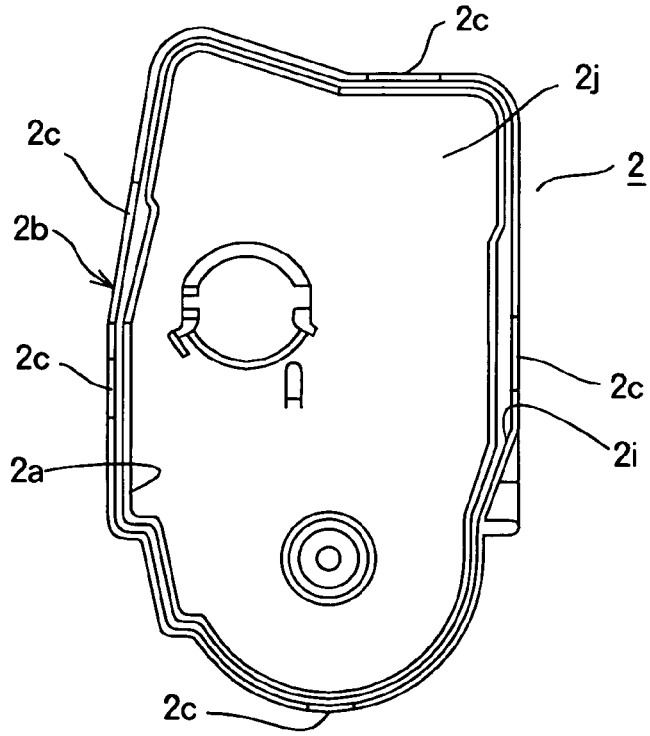
FIG. 9 is a side view of the lid taken along line B-B of FIG. 7.
Figure 10:
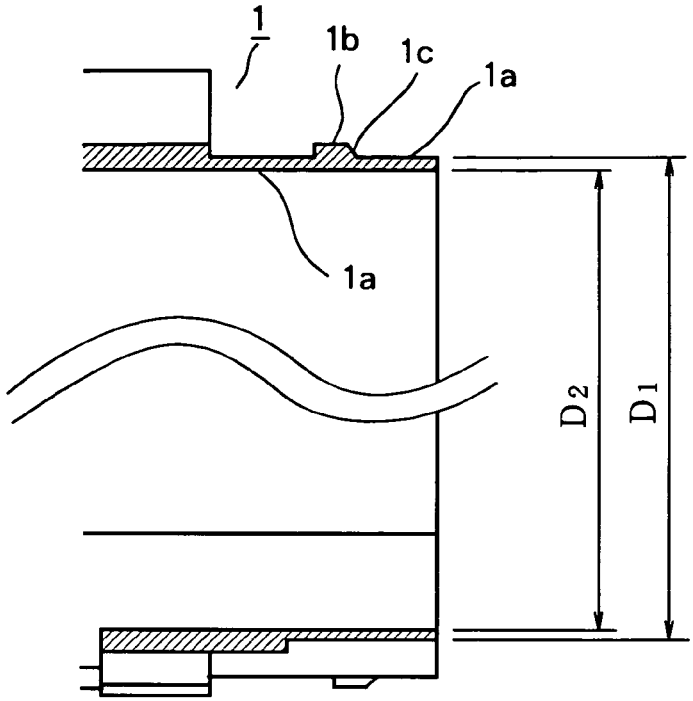
FIGS. 10, 11A, 11B and 12 are cross-sectional views in part of a fitting construction through which the waste toner chamber of the toner cartridge and the lid are fitted to each other.

FIG. 8 is a side view of the housing 1 taken along line A-A of FIG. 7. FIG. 9 is a side view of the lid 2 taken along line B-B of FIG. 7. Referring to FIG. 8, an outer peripheral wall 1*a* of the housing 1 extends all around the perimeter of the waste toner chamber 3. Referring to FIG. 9, an inner wall 2*a* and an outer wall 2*b* of the lid 2 extend all around the lid 2. Therefore, the entire periphery of the outer peripheral wall 1*a* of the housing 1 fits into an entire groove 2*i* defined between the inner wall 2*a* and outer wall 2*b* of the lid 2.

The housing 1 is molded from, for example, polyethylene having a tensile modulus of elasticity in the range of 281 to 907 kgf/mm$^2$, polypropylene having a tensile modulus of elasticity in the range of 112 to 663 kgf/mm$^2$, and acrylonitrile-butadiene-styrene (ABS) having a tensile modulus of elasticity in the range of 112 to 663 kgf/mm$^2$. The lid 2 is molded from, for example, polyethylene having a tensile modulus in the range of 281 to 907 kgf/mm$^2$ and EVA (ethylene vinegar picopolymer) having a tensile modulus in the range of 281 to 907 kgf/mm$^2$.

Figure 11A:
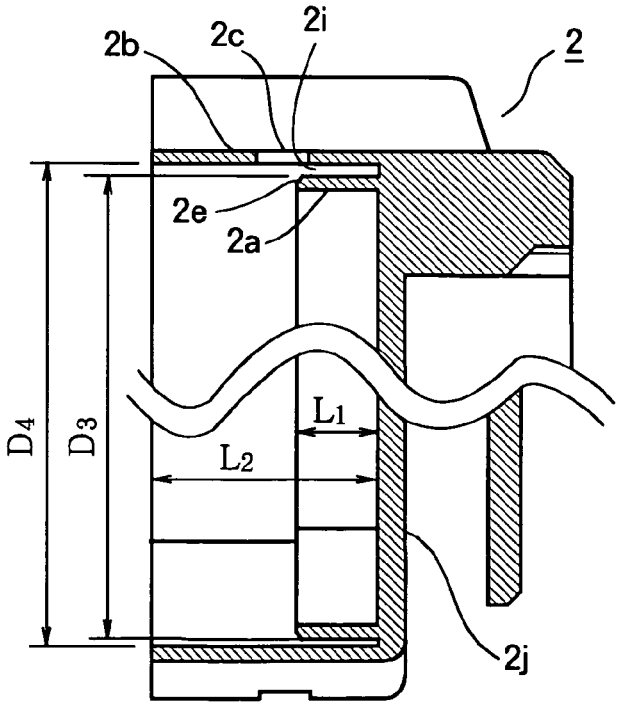

FIGS. 10, 11A, 11B and 12 are cross-sectional views in part of a fitting construction through which the waste toner chamber of the toner cartridge 13 and the lid 2 are fitted to each other. Referring to FIG. 11A, the outer peripheral wall 1*a* fits into the groove 2*i* defined between the inner peripheral wall 2*a* and outer peripheral wall 2*b*, thereby establishing a male-to-female fitting relation. The dimensions D1-D4 are such that D1≧D4 and D2≦D3, where D1 and D2 are an outer dimension and an inner dimension of the housing 1, respectively, D3 is an outer dimension of the inner peripheral wall 2*a* and D4 is an inner dimension of the outer peripheral wall 2*b*. Also, height L1 of the inner wall 2*a* and the height L2 of the outer wall 2*b* are related such that L1≦L2.

Figure 11B:
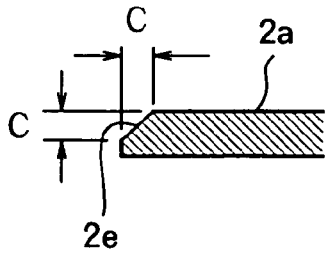
Figure 12:
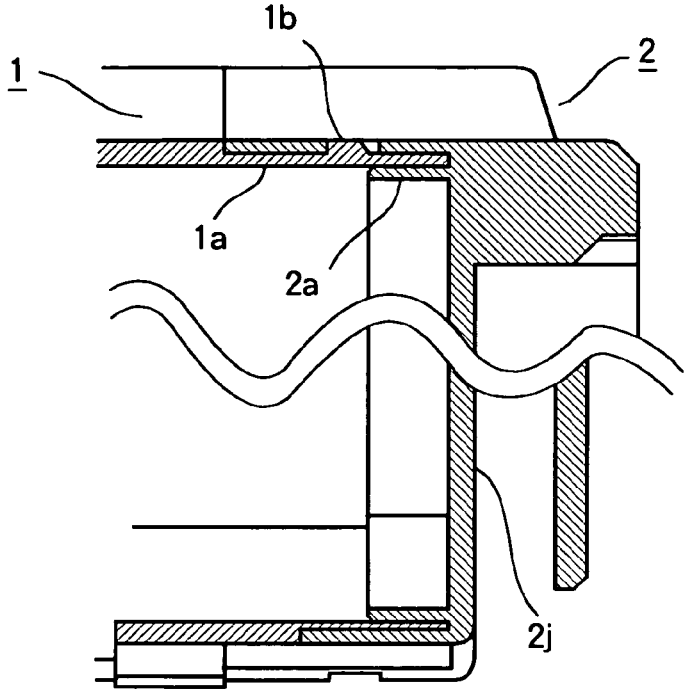

FIG. 11B is an enlarged view of a chamfered portion. The inner wall 2*a* has a chamfered portion 2*e* formed on an outer corner of the inner wall 2*a*. The chamfered portion 2*e* has a dimension C such that C>(D3-D2). A projection 1*b* is formed on the outer surface of the housing 1 and a hole 2*c* having a rectangular cross-section is formed in the outer wall 2*b* of the lid 2. The hole 2*c* receives the projection 1*b*. The projection 1*b* has a beveled surface 1*c*. When the projection 1*b* fits into the hole 2*c* completely, the lid 2 is firmly assembled to the housing 1.

The fitting engagement of the housing 1 and lid 2 will be described. Because the height L1 of the inner wall 2*a* and the height L2 are related such that L1≦L2, when the outer peripheral wall 1*a* of the housing 1 fits into an inner space defined by the outer wall 2*b* of the lid 2, the outer wall 2*b* guides the outer peripheral wall 1*a*. Because the chamfered portion 2*e* has a relation such that C>D3-D2, the outer peripheral wall 1*a* can be inserted into the space defined between the outer wall 2*b* and the inner wall 2*a*.

Because the outer wall 2*b* has a higher tensile modulus of elasticity than the housing 1, when the housing 1 is pushed into the lid 2 so that the outer peripheral wall 1*a* enters the lid 2, the outer wall 2*b* slightly deforms outwardly to run over the beveled surface 1*c* that serves as a guide. The housing 1 is further advanced so that the outer peripheral wall 1*a* enters the groove 2*i*. The housing 1 is molded from polypropylene while the lid 2 is molded from polystyrene. Thus, the inner wall 2*a* slightly deforms inwardly, so that the outer peripheral wall 1*a* is press-fitted into the groove 2*i* defined between the inner wall 2*a* and outer wall 2*b*.

When the outer peripheral wall 1*a* has entered the groove 2*i* sufficiently, the projection 1*b* snaps into the hole 2*d* formed in the outer wall 2*b* of the lid 2. When the projection 1*c* snaps into the hole 2*d*, the outer wall 2*b* resiliently returns to its original shape so that the corner of the projection 1*b* engages the hole 2*d* to be firmly locked to each other. The aforementioned construction in FIGS. 10, 11A, 11B and 12 can also be applied to the fitting construction between the lid 8 and the outer peripheral wall 1*a*.

Forming the lid 2 of a material having a smaller tensile modulus of elasticity than the housing 1 accommodates deflection and deformation of the lid 2 when the lid 2 is pressed into the housing.

The pressure contact between the outer peripheral wall 1*a* of the housing 1 and the inner wall 2*a* of the lid 2 provides a sealing against toner from leaking. The outer peripheral wall 1*a* of the housing 1 is sandwiched between the inner wall 2*a* and outer wall 2*b* and effectively increases the length of the path through which the toner leaks from the inside of the waste toner chamber to the outside. Thus, the sealing effect against toner leakage is improved.

When the outer peripheral wall 1*a* of the housing 1 enters into the groove 2*i* defined between the inner wall 2*a* and outer wall 2*b*, the relation L2>L1 allows the outer wall 2*b* to guide the outer peripheral wall 1*a*. This improves assembly efficiency.

The chamfered portion 2*e* has a dimension given by C>D3-D2 and guides the inner surface of the outer peripheral wall 1*a* so that the press-fitting of the housing is performed smoothly.

The press-fitting engagement between the housing 1 and lid 2 eliminates the need for a sealing member, thus reducing the manufacturing cost. Because the lid 2 is formed of a single material, simple injection molding can be used to form the lid 2.

The firm engagement between the projection 1*b* and hole 2*c* prevents the housing 1 from disengaging from the lid 2 when the apparatus is subject to shock or vibration. In addition, the engagement between the projection 1*b* and hole 2*c* can be visually checked easily. This is effective in reducing the chance of the apparatus being poorly assembled.

Second Embodiment

Figure 13:
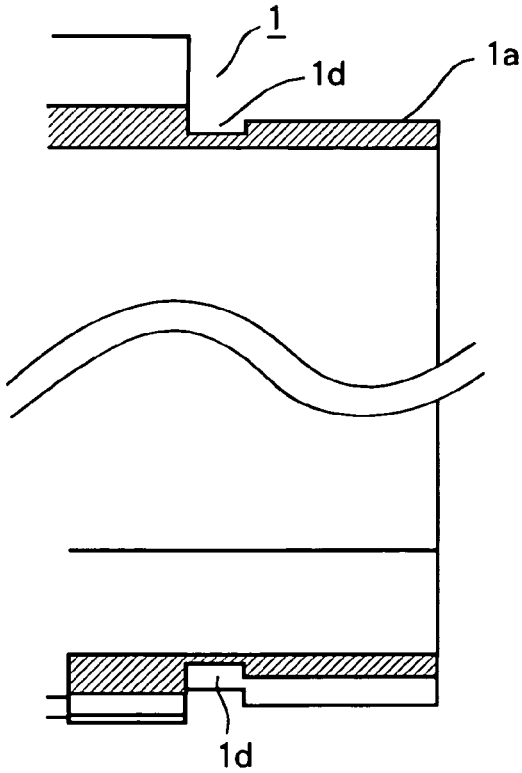
FIGS. 13-15 illustrate a toner cartridge according to a second embodiment, showing details of a fitting construction that extends all around the peripheral portions of the openings of the housing and the lid.
Figure 14:
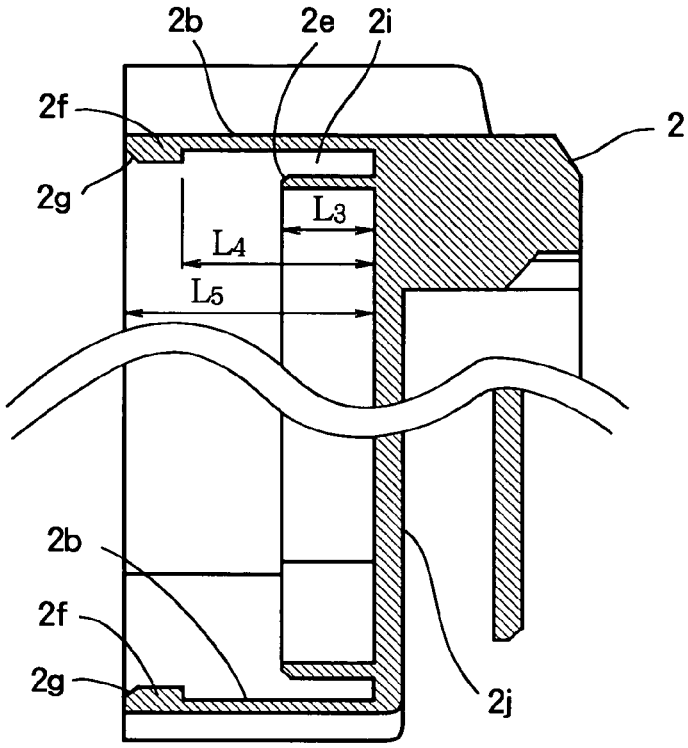
Figure 15:
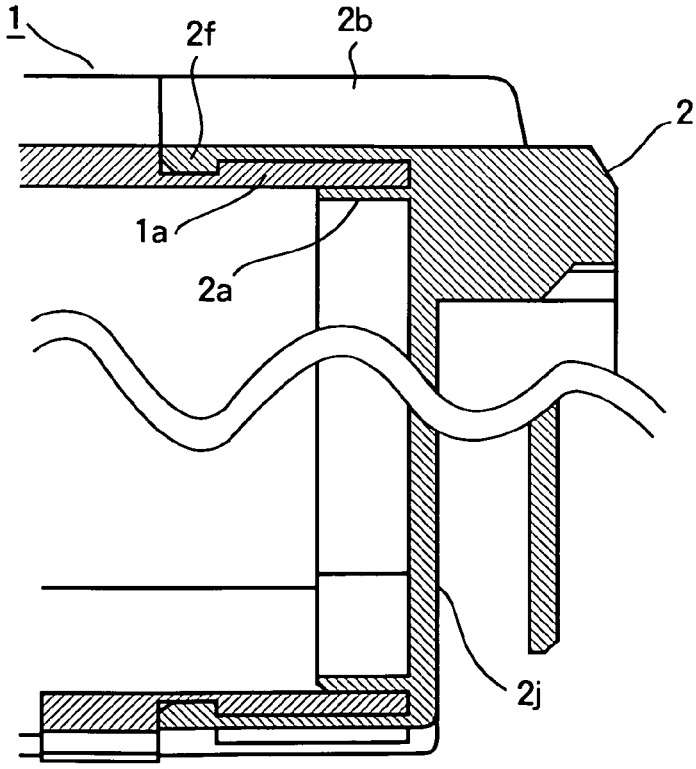

FIGS. 13-15 illustrate a toner cartridge 13 according to a second embodiment, showing details of a fitting construction that extends all around the peripheral portions of the openings of the housing 1 and the lid 2. A loop-like groove 1*d* is formed in the outer peripheral surface of the housing 1 near the opening, extending all around the outer peripheral surface. A loop-like projection 2*f* is formed on an inner surface of an outer wall 2*b* of the lid 2 to extend in a circumferential direction all around the perimeter of the inner surface. Just as in the first embodiment, an inner wall 2*a* of the lid 2 has a chamfered portion 2*e* at the outer corner of the inner wall 2*a*, the chamfered portion 2*e* extending in a circumferential direction all around the perimeter of the inner wall 2*a*.

There is a relation such that L5>L4>L3, where L5 is the height of the outer peripheral wall 1*a*, L4 is the height of a loop-like projection 2*f*, and L3 is the height of inner wall 2*a*. A chamfered portion 2*g* is formed on an inner corner of the loop-projection 2*f*, extending all around the loop-like projection 2*f*.

The lid 2 is formed of a material having a smaller tensile modulus of elasticity than the housing 1 and the loop-like projection 2*f* has the chamfered portion 2*g*, so that the outer peripheral wall 1*a* of the housing 1 is allowed to fit into the inner space of the outer wall 2*b* of the lid 2. When the outer peripheral wall 1*a* enters the opening of the lid 2, the loop-like projection 2*f* runs over the outer peripheral wall 1*a* to somewhat deform outwardly. As the outer peripheral wall 1*a* further advances into the lid 2, the loop-like projection 2*f* snaps into the loop-like groove 1*d*. When the loop-like projection 2*f* snaps into the loop-like groove 1*d*, the outer wall 2*b* regains its original shape so that the corner of the projection 2*f* engages the groove 1*d* to establish a firm locking engagement all around the outer peripheral wall 1*a*.

Third Embodiment

Figure 16:
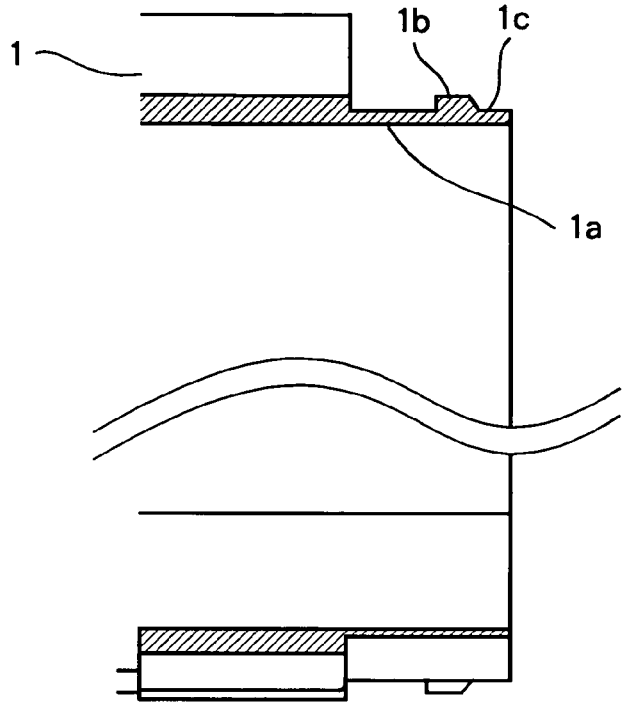
FIGS. 16-18 illustrate the configuration of a fitting construction according to a third embodiment.
Figure 17:
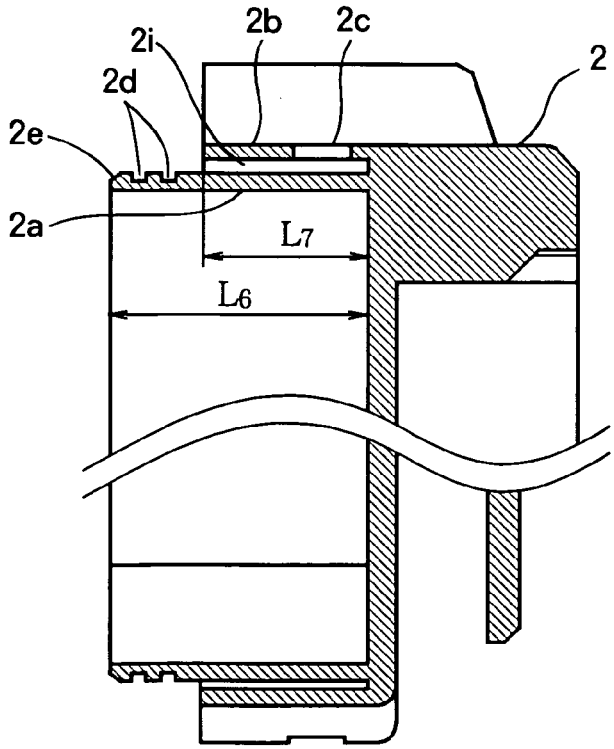
Figure 18:
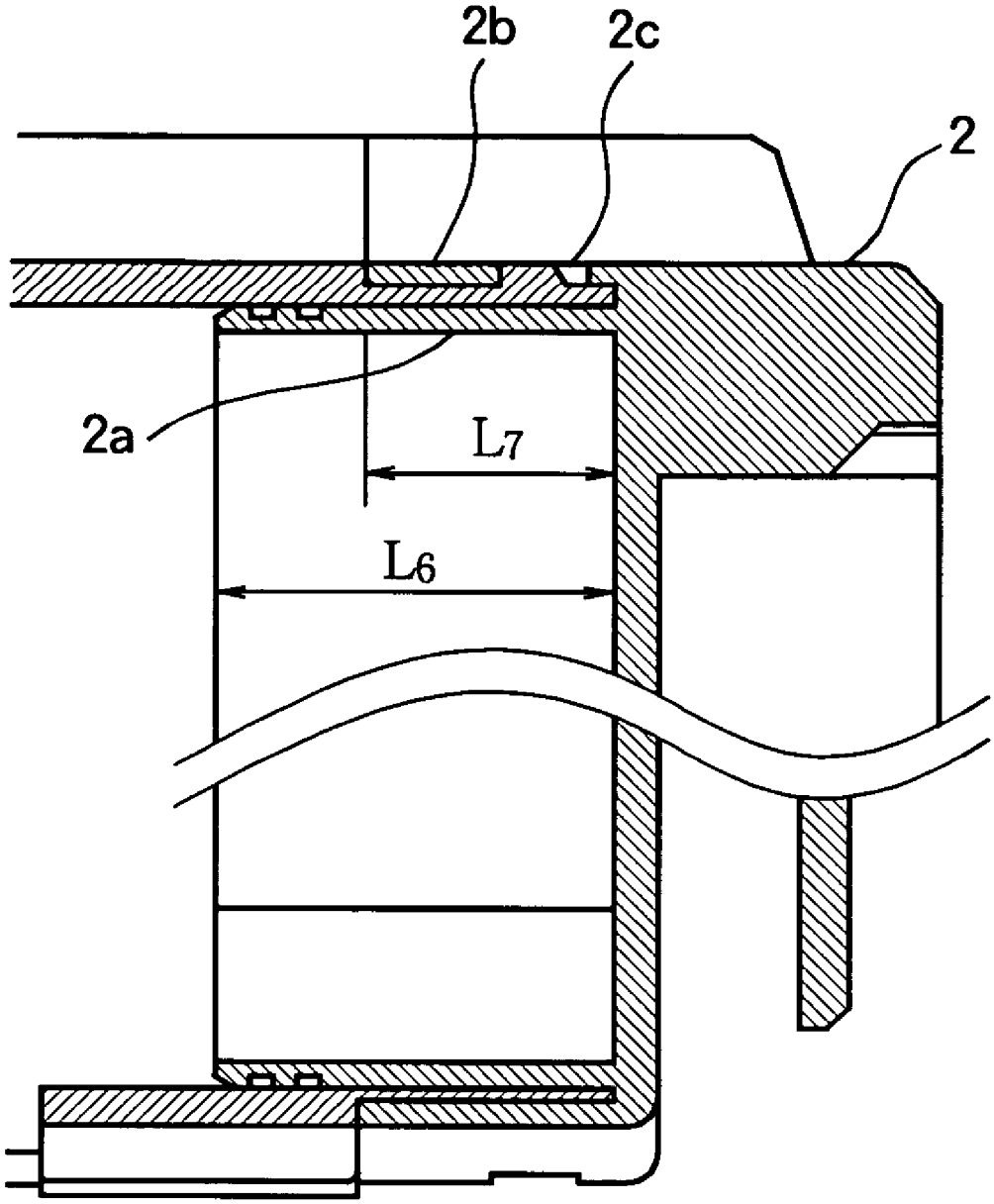

FIGS. 16-18 illustrate the configuration of a fitting construction according to a third embodiment. There are provided two grooves 2*d* that are formed in the outer peripheral surface of an inner wall 2*a* of a lid 2 and extend all around the outer peripheral surface of the inner wall 2*a*. There is a relation such that L6>L7, where L6 denotes the height of an inner wall 2*a* and L7 denotes the height of an outer wall 2*b*. The grooves 2*d* are above the outer wall 2*b* and therefore they are exposed and are visible. The grooves 2*d* have a depth smaller than half the thickness of the inner wall 2*a*. The loop-like projection 1*b* extends all around the outer peripheral wall 1*a* of the housing 1 and is a predetermined distance away from the opening.

The lid 2 is formed of a material having a smaller tensile modulus of elasticity than the housing 1 and the inner wall 2*a* has a chamfered portion 2*e*, so that the outer peripheral wall 1*a* of the housing 1 is allowed to fit over the inner wall 2*a* of the lid 2. When the outer peripheral wall 1*a* enters the groove 2*d* defined between the inner wall 2*a* and the outer wall 2*b*, the inner wall 2*a* slightly deforms inwardly while the outer wall 2*b* runs over the beveled surface 1*c* to resiliently deform slightly outwardly. As the outer peripheral wall 1*a* further advances into the lid 2, the projection 1*b* snaps into the hole 2*c*. When the projection 1*b* snaps into the hole 2*c*, the outer wall 2*b* regains its original shape so that the corner 1*b* of the projection 2*f* engages the hole 2*c* to establish a firm locking engagement between the housing 1 and the lid 2.

Once the outer peripheral wall 1*a* has been press-fitted into a groove 2*i* between the inner wall 2*a* and the outer wall 2*b*, the grooves 2*d* form small loop-like spaces between the outer peripheral wall 1*a* and the inner wall 2*a*. Therefore, even if a small amount of toner enters the fitting portion between the inner wall 2*a* and the outer peripheral wall 1*a* due to shock and vibration exerted from an external environment, the small amount of toner stays in the space. Thus, the toner will not leak outside of the apparatus at least until the space is completely filled with the toner.

In order for the inner wall 2*a* not to deform due to the forces exerted on the inner wall 2*a*, the grooves 2*d* has a depth less than half the thickness of the inner wall 2*a*. Because the grooves 2*d* are formed in the inner wall 2*a* higher than the outer wall 2*b*, the grooves can be molded by a simple molding operation.

Because the grooves are formed to extend all around the outer peripheral portion near the opening, the opening can be sealed sufficiently. Thus, the opening is not limited to a circular shape but may be various other shapes. Further, the corner of the wall may be formed in a variety of shapes such that there is no gap through which the toner leaks. A variety of shapes of the opening provides a high degree of freedom in terms of the design of toner cartridge. Thus, the shape of toner cartridge can be determined in accordance with the construction of image-forming apparatus while ensuring a required capacity of a developer holding section. The engagement between the projection 1*b* and hole 2*c* prevents the housing 1 from disengaging from the lid 2 when the apparatus is subject to shock or vibration.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fitting construction for a developer holding apparatus, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid and receives the first wall therein, the groove being recessed in a direction opposite to a direction in which said lid fits to said housing member to close the opening;

wherein the first wall fittingly engages into the groove to seal the opening.

2. The fitting construction according to claim 1, wherein said housing is formed of one of polyethylene, polypropylene, and acrylonitrile-butadiene-styrene (ABS) and said lid is formed of polyethylene.

3. The fitting construction according to claim 1, wherein the opening includes a non-circular cross section.

4. An image-forming apparatus that incorporates a fitting construction according to claim 1, wherein the apparatus comprising:

an image-bearing body;

a charging section that charges a surface of said image bearing body;

an exposing section that irradiates the charged surface of said image bearing body to form an electrostatic latent image on the surface;

a developing section that develops the electrostatic latent image into a visible image; and a transferring section that transfers the visible image onto a print medium.

5. The fitting construction according to claim 1, wherein the groove extends all around the opening.

6. A fitting construction for a developer holding apparatus, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid and receives the first wall therein, the groove extending substantially all around the opening;

wherein the first wall fittingly engages into the groove to seal the opening;

wherein said lid includes a second wall that closes the opening, a third wall that projects from the second wall, and a fourth wall that projects from the second wall and extends to surround the third wall, the third wall and fourth wall defining the groove between the third wall and the fourth wall;

wherein the first wall has an outer dimension equal to or larger than an inner dimension of the fourth wall.

7. The fitting construction according to claim 6, wherein the first wall has an inner dimension equal to or smaller than an outer dimension of the third wall.

8. The fitting construction according to claim 6, wherein the fourth wall has a higher height than the third wall.

9. The fitting construction according to claim 6, wherein the third wall has a chamfered portion formed at an outer corner of the third wall, the chamfered portion extending all around the third wall and having a width larger than a difference between an inner dimension of the first wall and an outer dimension of the third wall.

10. The fitting construction according to claim 6, wherein the fourth wall has a lower height than the third wall.

11. The fitting construction according to claim 10, wherein the third wall has at least one loop-like groove formed in an outer surface of the third wall.

12. A fitting construction for a developer holding apparatus, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid and receives the first wall therein;

wherein the first wall fittingly engages into the groove to seal the opening;

wherein said housing member has a first engagement portion and said lid has a second engagement portion, wherein said first wall is press-fitted into the groove and the first engagement portion fits to the second engagement portion, so that said housing member is locked to said lid.

13. The fitting construction according to claim 12, wherein the first engagement portion is a projection formed on an outer surface of the first wall and the second engagement portion is a portion defining a hole formed in said lid.

14. The fitting construction according to claim 12, wherein the first engagement portion is a loop-like groove that extends all around an outer surface of said first wall and the second engagement portion is a loop-like projection that extends all around the inner surface of the fourth wall.

15. A developer cartridge, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid and receives the first wall therein, the groove being recessed in a direction opposite to a direction in which said lid fits to said housing member to close the opening;

wherein the first wall fittingly engages into the groove to seal the opening.

16. The developer cartridge according to claim 15, wherein the groove extends all around the opening.

17. The developer cartridge claim 15, wherein said housing is formed of one of polyethylene, polypropylene, and acrylonitrile-butadiene-styrene (ABS) and said lid is formed of polyethylene.

18. The developer cartridge according to claim 15, wherein the first wall has an inner dimension equal to or smaller than an outer dimension of the third wall.

19. The developer cartridge according to claim 15, wherein the fourth wall has a higher height than the third wall.

20. The developer cartridge according to claim 15, wherein the opening includes a non-circular cross section.

21. The developer cartridge according to claim 15, wherein the fourth wall has a lower height than the third wall.

22. The developer cartridge according to claim 21, wherein the third wall has at least one loop-like groove formed in an outer surface of the third wall.

23. A developer cartridge, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid, the groove extending substantially all around the opening;

wherein the first wall fittingly engages into the groove to seal the opening;

wherein said lid includes a second wall that closes the opening, a third wall that projects from the second wall, and a fourth wall that projects from the second wall and extends to surround the third wall, the third wall and fourth wall defining the groove between the third wall and the fourth wall;

wherein the first wall has an outer dimension equal to or larger than an inner dimension of the fourth wall.

24. The developer cartridge according to claim 23, wherein the third wall has a chamfered portion formed at an outer corner of the third wall, the chamfered portion extending all around the third wall and having a width large than a difference between an inner dimension of the first wall and an outer dimension of the third wall.

25. A developer cartridge, comprising:

a housing member in which a developer chamber is defined, the developer chamber having a first wall that defines an opening;

a lid that fittingly closes the opening, said lid having a smaller tensile modulus of elasticity than said housing member and a groove that is formed in a peripheral portion of said lid;

wherein the first wall fittingly engages into the groove to seal the opening;

wherein said housing member has a first engagement portion and said lid has a second engagement portion, wherein said first wall is press-fitted into the groove and the first engagement portion fits to the second engagement portion, so that said housing member is locked to said lid.

26. The developer cartridge according to claim 25, wherein the first engagement portion is a projection formed on an outer surface of the first wall and the second engagement portion is a portion defining a hole formed in said lid.

27. The developer cartridge according to claim 25, wherein the first engagement portion is a loop-like groove that extends all around the outer surface and the second engagement portion is a loop-like projection that extends all around the inner surface of the fourth wall.

* * * * *